United States Patent [19]

Karliner et al.

[11] Patent Number: 4,551,036

[45] Date of Patent: Nov. 5, 1985

[54] PAINT DISPENSING SYSTEM INCLUDING ROLLER WITH DRIP TROUGH

[75] Inventors: Rudolf R. Karliner, Minnetonka; Samuel R. Carlin, St. Michael, both of Minn.

[73] Assignee: Wagner Spray Tech Corporation, Minneapolis, Minn.

[21] Appl. No.: 602,208

[22] Filed: Apr. 19, 1984

[51] Int. Cl.[4] ..... B05C 17/02

[52] U.S. Cl. ..... 401/131; 401/15; 401/146; 401/188 R; 401/208

[58] Field of Search ..... 401/15, 131, 146, 149, 401/188 R, 197, 208

[56] References Cited

U.S. PATENT DOCUMENTS

| | | | |
|---|---|---|---|
| 3,195,170 | 7/1965 | Howard | 15/526 |
| 3,776,645 | 12/1973 | Walker | 401/183 |
| 3,933,415 | 1/1976 | Woolpert | 401/145 |
| 4,072,429 | 2/1978 | Terzian et al. | 401/146 |
| 4,231,668 | 11/1980 | Groth et al. | 401/146 |

FOREIGN PATENT DOCUMENTS

| | | | |
|---|---|---|---|
| 171841 | 9/1916 | Canada | 401/131 |

*Primary Examiner*—Steven A. Bratlie

*Attorney, Agent, or Firm*—Hill, Van Santen, Steadman & Simpson

[57] ABSTRACT

A paint dispensing system including a pressure-tight container for holding paint under pressure, the container having spaced vents along a base portion thereof, a resilient securing means on the container in spaced relation to the vents, and a trough having a pair of spaced tabs extending therefrom and proportioned to be received in the vents to hold the trough in a generally horizontal position. The trough serves as a receptacle for a paint roller comprising a handle and a paint roller assembly detachably secured to the handle, the handle being insertable into the resilient securing means to hold the paint roller suspended above the trough.

8 Claims, 5 Drawing Figures

PAINT DISPENSING SYSTEM INCLUDING ROLLER WITH DRIP TROUGH

BACKGROUND OF THE INVENTION

1. Field of the Invention

This invention is in the field of paint dispensing systems of the type employing a pressurized container for delivering paint or other coating material through a flexible tube to a paint applicator such as a roller. The present invention has particular reference to a container which has provisions on it for supporting a paint roller above a trough, the trough being removable from the container and providing a freestanding trough structure for the roller.

2. Description of the Prior Art

Pressurized paint dispensing systems have become quite popular in recent years. These systems generally include a pressurized receptacle for the paint, the pressure being supplied internally by means of a motor and compressor which serve to apply a pressurized blanket of air over the paint in the container. A handle assembly including a valve receive the paint through a flexible hose and deliver it uniformly to the interior of a paint roller. Painting with this type of system is considerably quicker than with the paint roller and tray combination of the past since the roller is constantly fed with paint at a controllable pressure. The time required for painting a given area is thus reduced by a very substantial factor inasmuch as the user does not have to constantly dip the roller into a tray full of paint.

Even though the pressurized delivery system represents a significant improvement over a roller and tray combination, both systems still have the problem of adequately supporting the paint roller during periods when the roller is not in use without the problem of paint dripping.

SUMMARY OF THE INVENTION

The present invention provides an improved support for a paint roller in conjunction with the pressure-tight container whereby the roller is hung upside down over a trough so that if paint does begin to run, such running is harmless as it is caught by the trough.

One of the features of the present invention is the provision of a resilient securing means on the pressurized container in spaced relation to a detachable trough. The trough has a pair of spaced tabs extending therefrom which are proportioned to be received in air cooling vents formed at the bottom of the container structure. These tabs are composed of a flexible plastic material and can be positioned in the vents to hold the trough in a generally horizontal position. Thus the paint roller with its handle can be supported upside down with the handle being received in the resilient securing means and serving to hold the paint roller suspended over the trough at an adjustable position.

Another feature of the present invention resides in providing a resilient securing means which has a recessed channel and resilient projections extending from opposite sides of the channel to provide a wedged engagement for the handle in the channel. The recessed channel may be made integral with the container itself.

In the preferred form of the invention, the spaced vents in the housing are vertically elongated slots and the tabs each inolude a notch therein for locking each tab at the base of one of the slots. In a preferred form of the invention, the resilient securing means are provided as an integral part of the removable cover which sealingly engages the paint container in pressure-tight relationship.

In another feature of the invention, the tabs are spaced sufficiently far apart and are sufficiently long to provide a freestanding trough structure which can be used on the job site independently of the pressurized container.

BRIEF DESCRIPTION OF THE DRAWINGS

The drawings illustrate a preferred form of the present invention as follows.

DESCRIPTION OF THE PREFERRED EMBODIMENTS

Figure 1:
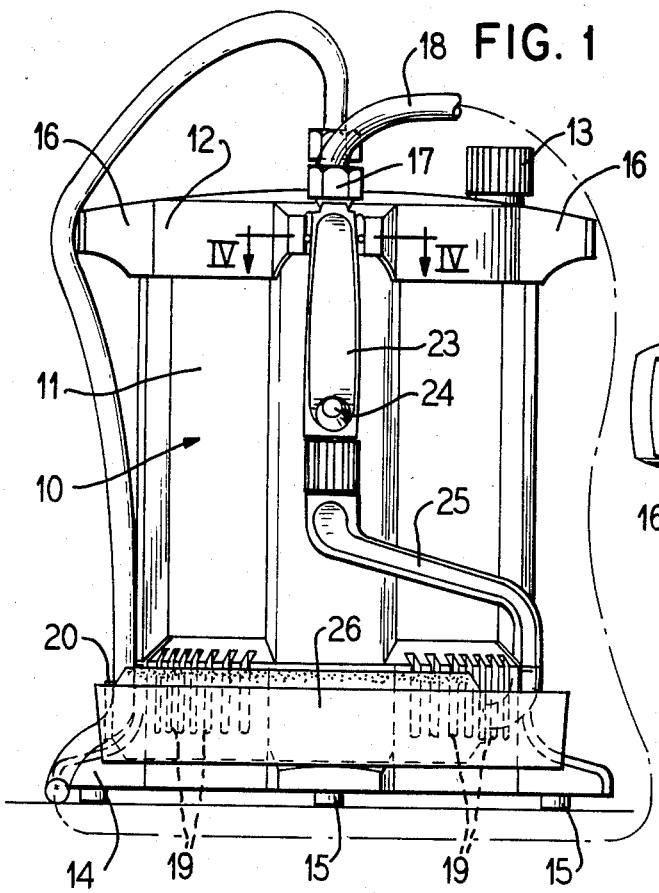
FIG. 1 is a view in elevation of a paint dispensing system according to the present invention.

In FIG. 1, reference numeral 10 indicates generally a pressure-tight container including a pressure canister 11 and a twist-lock top 12 which is sealingly engageable with the canister 11 to provide a pressure-tight container for paint or other coating material. A locking and pressure relief knob 13 is conventionally employed to provide for the release of the interior pressure in the canister before the top 12 can be disengaged from the casing 11. At the bottom of the casing 11 are a plurality of feet 14 to which are secured resilient spacers 15 which rest on a floor surface. Opposed handles 16 enable the user to rotate the cover 12 relative to the canister 11 and lock the cover into press-tight sealing relationship with the canister.

A can of paint (not shown) is positioned inside the canister. At the bottom of the canister, there is a space provided for a motor and compressor assembly which supplies air under pressure to the contents of the canister, forcing the paint out through a fitting 17 and into a flexible paint hose 18. The space surrounding the motor and compressor unit is provided with spaced vents along the perimeter, the vents being a series of vertically elongated slots, which permit the flow of air past the motor and compressor assembly, thereby assisting in cooling the same.

Figure 2:
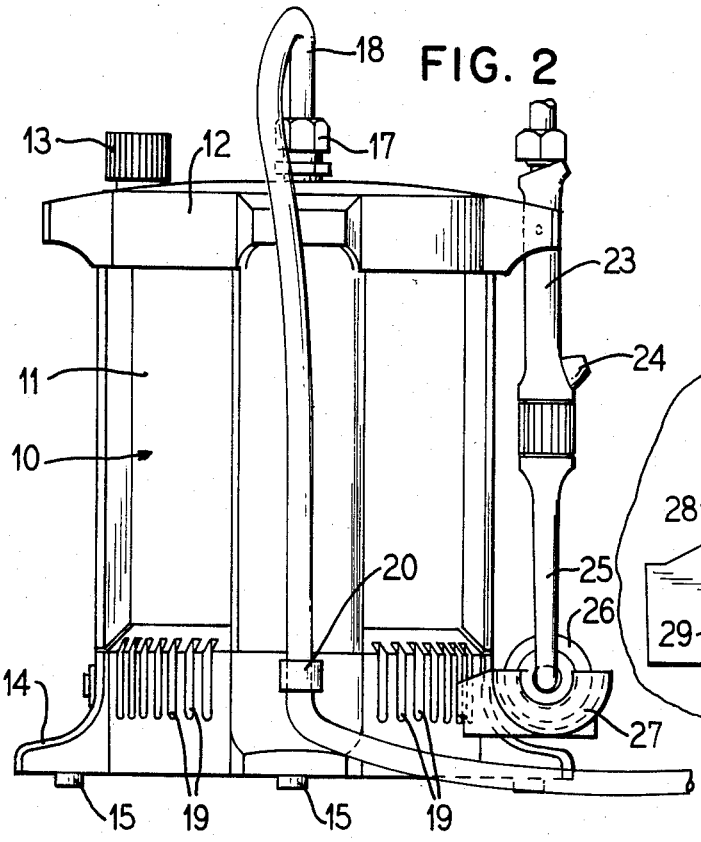
FIG. 2 is a side elevational view of the assembly shown in FIG. 1.

The flexible paint hose 18, as illustrated in FIG. 2 is confined against the casing by means of a hose clip 20 which is integrally struck from the perimeter of the housing. Positioning the hose clip near the bottom of the assembly makes it more difficult to tip the housing over by pulling on the paint hose since the hose clip 20 is located substantially below the center of gravity of the housing.

Figure 4:
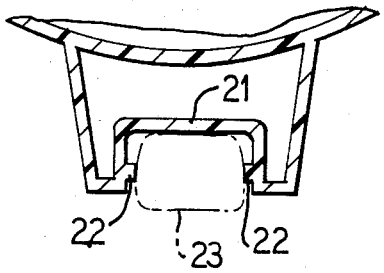
FIG. 4 is a fragmentary cross-sectional view on an enlarged scale taken substantially along the line IV—IV.

One of the features of the present invention provides a means for securing a paint roller to the pressure-tight container when the roller is not in use. This is accomplished by providing a resilient securing means on the container best illustrated in FIGS. 2 and 4. The securing means includes a recessed channel 21 which is formed integrally with the container and which has spaced resilient projections 22 (FIG. 4) extending from opposite sides of the channel. These projections 22 are spaced sufficiently so that they tightly receive a handle 23 of the paint roller assembly in tight wedged engagement. The handle also carries an operating button 24 which controls the flow of paint from the hose 18 into a hollow arm 25 feeding a hollow paint roller 26.

Figure 5:
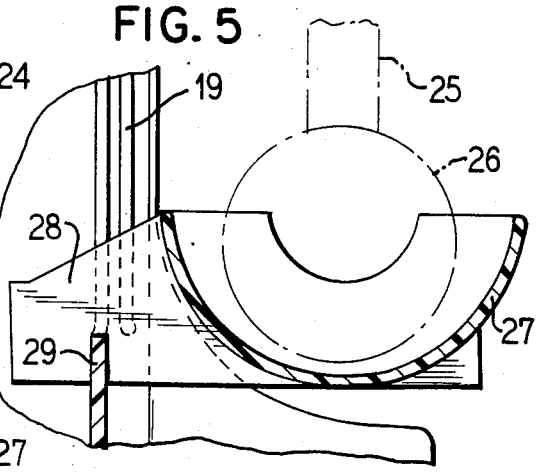
FIG. 5 is a fragmentary cross-sectional view of the roller and trough assembly.

As best illustrated in FIG. 2, the roller assembly is supported in inverted relationship above a trough 27 composed of a flexible plastic material, and having a pair of spaced tabs 28 extending therefrom as best seen in FIG. 5. Each of the tabs has a slot 29 which is proportioned to be received against the base of one of the vent grooves 19 so that the trough is locked in position as illustrated in FIGS. 3 and 5 with the roller 26 being adjustably positionable with respect to the base of the trough 27.

The roller assembly can thus be temporarily secured against the container with the handle portion 23 being received in the channel 21 of the resilient securing means, and the roller 26 being supported in spaced relation to the base of the trough 27. Consequently, any dripping which might occur from the roller is picked up by the trough 27.

Figure 3:
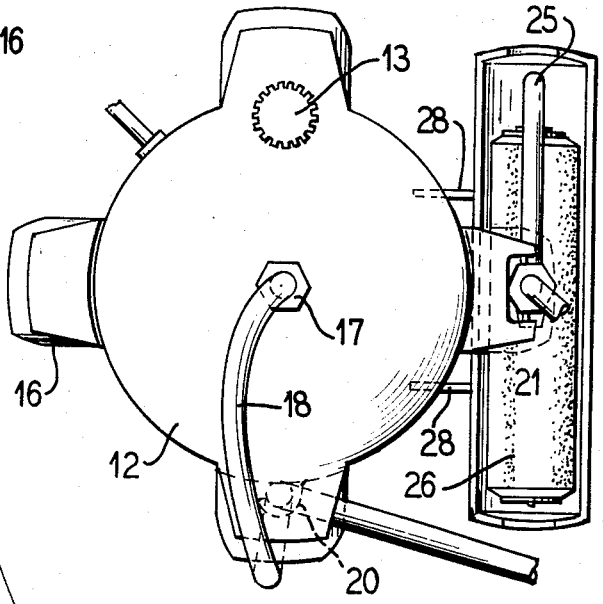
FIG. 3 is a plan view of the paint dispensing system.

As best illustrated in FIG. 3, the tabs 28 are spaced sufficiently apart and are of sufficient length to provide a freestanding trough structure when the tabs 28 are disengaged from the slots 19. The trough structure can thus be used remotely from the pressurized container as a temporary support for the roller.

The paint dispensing system of the present invention therefore provides a convenient means for securing the roller when the roller is temporarily idled, without danger of dripping paint on the surroundings.

It should be evident that various modifications can be made to the described embodiments without departing from the scope of the present invention.

We claim as our invention:

1. A paint dispensing system comprising a pressure-tight container for holding paint under pressure, said container having spaced vents along a base portion thereof, resilient securing means on said container, a trough having a pair of spaced tabs extending therefrom and proportioned to be received in said vents to hold said trough in a generally horizontal position, a handle, and a paint roller detachably secured to said handle, said handle being insertable into said resilient securing means to hold said paint roller suspended above said trough.

2. A paint dispensing system according to claim 1 in which said resilient securing means includes a recessed channel and resilient projections extending from opposite sides of said channel to provide a wedged engagement for said handle in said channel.

3. A paint dispensing system according to claim 2 in which said recessed channel is integral with said container.

4. A paint dispensing system according to claim 1 in which said spaced vents comprise vertically elongated slots, and said tabs each include a notch therein for locking said tab at the base of one of said slots.

5. A paint dispensing system according to claim 1 in which said tabs are composed of a resilient plastic material.

6. A paint dispensing system according to claim 1 which includes a flexible hose connected to said handle and hose clip means located near the base of said container arranged to hold a portion of said flexible hose against said container.

7. A paint dispensing system according to claim 1 wherein said container includes a paint canister and a removable cover sealingly engaged in pressure-tight relationship with said canister, said resilient securing means being formed integrally with said cover.

8. A paint dispensing system according to claim 1 wherein said tabs are spaced sufficiently far apart and are of sufficient length to provide a freestanding trough structure.

* * * * *